US009967684B2

(12) United States Patent
Ingemarsson et al.

(10) Patent No.: US 9,967,684 B2
(45) Date of Patent: May 8, 2018

(54) ALERTING SYSTEM FOR DEAF OR HARD OF HEARING PEOPLE AND APPLICATION SOFTWARE TO BE IMPLEMENTED IN AN ELECTRONIC DEVICE

(71) Applicant: Bellman & Symfon Europe AB, Askim (SE)

(72) Inventors: Anders Ingemarsson, Kungsbacka (SE); Peter Jungvid, Hovås (SE)

(73) Assignee: BELLMAN & SYMFON EUROPE AB, V. Froelunda (SE)

( * ) Notice: Subject to any disclaimer, the term of this patent is extended or adjusted under 35 U.S.C. 154(b) by 0 days. days.

(21) Appl. No.: 15/300,172

(22) PCT Filed: Mar. 28, 2014

(86) PCT No.: PCT/EP2014/056361

§ 371 (c)(1),
(2) Date: Sep. 28, 2016

(87) PCT Pub. No.: WO2015/144249

PCT Pub. Date: Oct. 1, 2015

(65) Prior Publication Data

US 2017/0142529 A1 May 18, 2017

(51) Int. Cl.
*H04R 25/00* (2006.01)
*G10L 25/51* (2013.01)

(52) U.S. Cl.
CPC ..... *H04R 25/554* (2013.01); *G10L 25/51* (2013.01); *H04R 25/43* (2013.01); *H04R 25/558* (2013.01); *H04R 2225/55* (2013.01)

(58) Field of Classification Search
CPC .... H04R 25/55; H04R 25/554; H04R 25/558; H04R 29/00
USPC ..... 340/539.11, 4.37, 7.61, 565; 381/60, 381/312, 313, 314, 315; 600/316; 348/14.01; 368/10; 455/456.3; 607/55
See application file for complete search history.

(56) References Cited

U.S. PATENT DOCUMENTS 8,073,171 B2 * 12/2011 Haenggi ..... H04R 5/033 381/23.1
8,155,359 B2 * 4/2012 Beck ..... H04R 25/554 381/315
8,175,306 B2 * 5/2012 Meskens ..... H04R 25/552 381/23.1
8,588,443 B2 * 11/2013 Glatt ..... H04R 25/552 368/47
8,712,083 B2 * 4/2014 Solum ..... H04R 25/30 381/315

(Continued)

FOREIGN PATENT DOCUMENTS

EP 1460769 A1 9/2004
EP 2472907 A1 7/2012
WO WO 2004/110099 A2 12/2004

*Primary Examiner* — Gerald Gauthier
(74) *Attorney, Agent, or Firm* — Saliwanchik, Lloyd & Eisenschenk

(57) ABSTRACT

An alerting system for deaf or hard of hearing people comprises a wireless network with one or more transmitters adapted to detect events and, upon detecting an event, to transmit a wireless alerting signal to one or more receivers adapted to alert a user. The wireless network is adapted to send an alerting signal to an electronic device in order to allow the electronic device to function as a gateway between said wireless network and a hearing aid device.

24 Claims, 4 Drawing Sheets

(56) References Cited

U.S. PATENT DOCUMENTS 8,760,284 B2 * 6/2014 Petersen ..... G08B 1/08 340/4.1
9,036,845 B2 * 5/2015 Rasmussen ..... H04R 25/554 381/313
9,137,613 B2 * 9/2015 El-Hoiydi ..... H04B 7/0667
9,143,872 B2 * 9/2015 Roos ..... H04R 25/55
9,247,354 B2 * 1/2016 Boguslavskij ..... H04L 7/041
9,439,006 B2 * 9/2016 Sacha ..... H04R 25/558
9,544,699 B2 * 1/2017 Haubrich ..... H04R 25/554
9,712,934 B2 * 7/2017 Moore ..... A61B 5/123
2005/0041531 A1 * 2/2005 Sekura ..... G06F 19/3406 368/10
2006/0245609 A1 11/2006 Arz et al.
2006/0279405 A1 * 12/2006 Erickson ..... G08B 1/08 340/7.61
2007/0009124 A1 * 1/2007 Larsen ..... H04R 25/554 381/315
2007/0120667 A1 * 5/2007 Mainini ..... G08B 13/122 340/565
2008/0049957 A1 * 2/2008 Topholm ..... H04R 25/558 381/315
2008/0186199 A1 * 8/2008 Lynn ..... H04M 1/0291 340/4.37
2008/0240453 A1 * 10/2008 Westergaard ..... H04R 25/70 381/60
2009/0174759 A1 * 7/2009 Yeh ..... H04N 7/142 348/14.01
2009/0185703 A1 * 7/2009 Aida ..... H04R 25/70 381/314
2010/0310102 A1 * 12/2010 Melone, II ..... H04R 25/70 381/314
2011/0045847 A1 * 2/2011 Roin ..... H04W 4/02 455/456.3
2011/0137141 A1 * 6/2011 Razoumov ..... A61B 5/0002 600/316
2012/0321112 A1 12/2012 Schubert et al.
2014/0334629 A1 * 11/2014 Andersen ..... H04R 25/70 381/60
2014/0369536 A1 * 12/2014 Kirkwood ..... H04R 25/55 381/312
2015/0049892 A1 * 2/2015 Petersen ..... H04R 25/554 381/315
2015/0172838 A1 * 6/2015 Kuk ..... A61B 5/00 381/314
2015/0256942 A1 * 9/2015 Kinsbergen ..... H04R 25/30 381/313
2015/0281863 A1 * 10/2015 Westergaard ..... H04R 25/70 381/60
2017/0142529 A1 * 5/2017 Ingemarsson ..... H04R 25/554

* cited by examiner

ALERTING SYSTEM FOR DEAF OR HARD OF HEARING PEOPLE AND APPLICATION SOFTWARE TO BE IMPLEMENTED IN AN ELECTRONIC DEVICE

CROSS-REFERENCE TO RELATED APPLICATIONS

The present application is the U.S. National Stage Application of International Patent Application No. PCT/EP2014/056361, filed on Mar. 28, 2014, which is hereby incorporated by reference herein in its entirety, including any figures, tables, or drawings.

The invention relates to an alerting system for deaf or hard of hearing people, said alerting system comprising a wireless network with one or more transmitters adapted to detect events and, upon detecting an event, to transmit a wireless alerting signal to one or more receivers adapted to alert a user. The invention relates to a corresponding application software to be implemented in an electronic device.

Alerting systems for deaf or hard of hearing people have been on the market for a long time. See for example the technical manual of the applicant "Technical Solutions", English 1.4, 2009, 204 pages, to be downloaded under www.bellman.com. Such modular alerting systems comprise for example transmitters for detecting events like incoming calls on landline telephones or incoming skype calls, smoke alarm, door bell ringing or baby cry. In case a transmitter detects such an event, it sends an alerting signal to one or more receivers, like wrist receiver, pager receiver, alarm clock, portable receiver, flash receiver, portable flash receiver. The receiver alerts a user either directly, or by activating a separate alerting device, for example a bed shaker.

It is desirable to alert a user through a hearing aid device in case of an alerting signal transmitted from a transmitter of the wireless network. Towards this aim, US 2007/009124 A1 discloses a hearing aid device comprising a transceiver for interconnection of the hearing aid device with a wireless network for communication with a plurality of other devices, like door bell, mobile phone, cordless phone, TV set, fitting instrument, and a communication controller that is adapted for controlling data exchange through the network in accordance with a simple proprietary network protocol. Here, the hearing aid device of this prior art is integrated into the wireless network as a network component. However, since hearing aid devices are usually small, the range of the user will be limited, for the following reasons. For one, it is very difficult to integrate a large antenna into the hearing aid device. Furthermore, electronics adapted to the special transmission frequency used in the wireless network must be integrated into the hearing aid device, which is a complex and expensive task. Generally, an important feature of the radio protocol and radio technology integrated in the hearing aid device is that the energy consumption is very low. This requirement makes it even more difficult to use a standardized protocol, or a protocol used in the wireless network.

The problem underlying the present invention is to provide an alerting system and an application software which allow to alert a user through a hearing aid device in case of an alerting signal transmitted from a transmitter in the wireless network in a simple manner and with significantly increased range.

The invention solves this problem with the features of the independent claims. By using an electronic device functioning as a gateway between the wireless network and a hearing aid device, the hearing aid device is notified of an alerting signal from the wireless network via said electronic device, only, i.e. without direct connection between the wireless network and the hearing aid device. In this manner it is possible to alert a user through a hearing aid device in case of an alerting signal transmitted from a transmitter of the wireless network. Most important, since the electronic device can be larger than the hearing aid device, the components defining the range relative to the wireless network, like antenna and radio electronics, to be integrated into the electronic device can be made much larger, such that the range of the user carrying the hearing aid device relative to the wireless network can be dramatically increased as compared to the prior art. According to the invention, therefore, the hearing aid device advantageously is not a network component of the wireless network. Furthermore, according to the invention the integration of the wireless network can be simplified.

The electronic device may in particular be a smart electronic device like a smart phone, a tablet computer, also called tablet or smart pad or a phablet. The smart electronic devices that are capable of implementing the application software and function to form an interface to the hearing aid device advantageously comprise standardized connectivity technologies, for example, but not limited to, Bluetooth Low Energy, GSM, 3G, 4G, WiFi and/or Internet access technology. The electronic device may also be a mobile phone, in particular a Bluetooth capable mobile phone, a mobile electronic device, a mobile communication device, a personal electronic device, a smart watch and/or a smart TV. The electronic device advantageously comprises a display, preferably a touch-sensitive display.

An aspect of the invention relates to an application software, in particular a mobile application software, also called mobile app or app, to be implemented in a electronic device, wherein the application software controls said electronic device to send a notification signal to a hearing aid device upon receiving an alerting signal from a wireless network for deaf and hard of hearing people.

Preferably the notification signal is transmitted from the electronic device to the hearing aid device using Bluetooth, in particular Bluetooth Low Energy. Bluetooth Low Energy, also known as BLE or Bluetooth Smart, relates to Bluetooth standard 4.0 or higher. Alternatively, the notification signal may be transmitted from the electronic device to the hearing aid device using a proprietary radio transmission standard of the hearing aid device manufacturer. Generally the notification signal is preferably transmitted from the electronic device to the hearing aid device on the ISM 2.4 GHz radio band.

The invention advantageously benefits from advanced wireless technology which has been introduced into hearing aid devices recently. The driver for this technology evolution is mainly the feature to stream audio directly from an accessory, like a remote microphone or an accessory connectable to an audio source like a TV or an audio system, to the hearing aid device. The advanced wireless technology preferably enables to create a direct link between the electronic device and the hearing aid device. This allows a user to get streamed sound like telephone speech and music from the electronic device to the hearing aid device. Applying this technology to the invention, the notification signal is preferably transmitted from the electronic device to the hearing aid device as an audio stream.

In some preferred embodiments of the invention, a transmitter and/or a receiver of the wireless network is adapted to transmit an alerting signal directly to the electronic device, in particular using Bluetooth, more particularly Bluetooth Low Energy. In other preferred embodiments of the invention, the alerting signal is transmitted from said wireless network to said electronic device via a cellular network.

Preferably the electronic device comprises a remote control function adapted to change settings of the hearing aid device. A separate remote control for controlling the characteristic and response of the hearing aid can be dispensed with. In other words, the electronic gateway device and the remote control are integrated into one electronic device, which usually is in near proximity to the user, typically in a pocket, over most of the time in which the user uses the hearing aid device.

In addition to alerting the user through the hearing aid device, the electronic device may preferably be adapted to provide a visual and/or tactile signal to a user upon receiving an alerting signal from said wireless network.

Further preferably, a pattern of an audio signal in the hearing aid device and/or the visual and/or tactile signal in the electronic device is different depending on the type of event that has caused the alerting signal in the wireless network. This may be settable by the user using the application software of the electronic device.

The application software in the electronic device preferably enables the user to customize or set the characteristic of the alerting signal to be sent to the hearing aid device. This may comprise setting which alarms are forwarded to the hearing aid device, and/or setting specific alerting sound characteristics. This function may also comprise setting at least one alerting mode in the electronic device, wherein signals from per-defined transmitters of the wireless network only are transmitted to the hearing aid device depending on the set alerting mode. For example, in a meeting mode only emergency alerts like smoke alarms are forwarded to the hearing aid device.

In the following the invention shall be illustrated on the basis of preferred embodiments with reference to the accompanying drawings, wherein.

Figure 1:
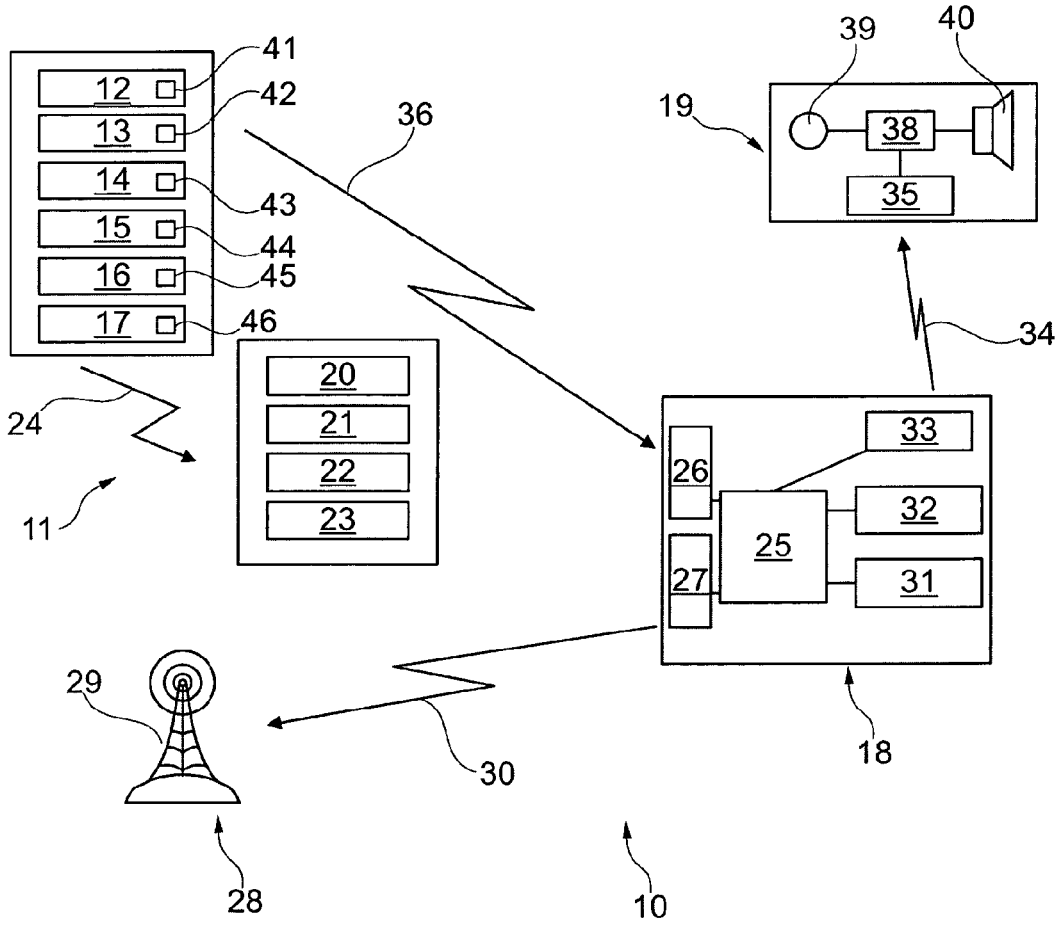
FIG. 1 shows an alerting system in a first embodiment of the invention.

The alerting system 10 comprises a wireless network 11, an electronic device 18, here a smart electronic device like a smart phone or a tablet computer, and a hearing aid device 19. The wireless network 11 is modular and comprises one or more transmitters 12 to 17 adapted to detect events like door bell ringing from a door bell 12, smoke alarm from a smoke alarm detector 13, baby cry from a baby cry monitor 14, incoming calls on a landline telephone 15, alarm of an alarm clock 16, and/or a notification signal from another notification device 17. Furthermore, the wireless network 11 comprises one or more receivers 20 to 23 like wrist receiver 20, flash receiver 21, also comprising portable flash receiver, alarm clock receiver 22, and/or other notification receivers 23 like pager receiver or portable receiver.

The smart electronic device 18 comprises a signal processor 25, a Bluetooth Low Energy receiving means 26, a radio receiving means 27, a visual indicator 31, a tactile actuator 32 and a transmitter and/or receiver 33. The Bluetooth Low Energy receiving means 26 is adapted to establish one or more BLE connections 36, 37 with the wireless network 11. The radio receiving means 27 is adapted to establish a radio connection 30 to a cellular mobile communication network 28 comprising a plurality of base stations 29 using a digital communication standard like GSM, 3G, 4G or the like. The Bluetooth Low Energy receiving means 26 and/or the radio receiving means 27 may be transceiving means, i.e. adapted to bidirectional communication. The visual actuator 31 may be a display, preferably a touch sensitive display, or for example an LED indicator. The tactile actuator 32 may be a vibration element. The transmitter or transceiver 33 is provided for establishing a wireless radio connection 34 to the hearing aid device 19 which comprises a corresponding receiver or transceiver 35. The wireless radio connection 34 may in particular be a Bluetooth Low Energy connection, or alternatively a proprietary radio standard of the manufacturer of the hearing aid device 19. The wireless radio connection 34 is preferably adapted to transmit an audio stream from the smart electronic device 18 to the hearing aid device 19. The Bluetooth Low Energy receiving means 26 and the transmitter or transceiver 33 may be realized in one Bluetooth Low Energy transceiver. The signal processor 25 controls the elements 26, 27, 31-33 of the smart electronic device 18 by means of a specifically adapted mobile application software (mobile app or app).

The hearing aid device 19 may be an ITE (In The Ear) or a BTE (Behind The Ear) device. In the embodiments shown in the Figures, the hearing aid device 19 comprises a signal processor 38, a microphone 39 and a loudspeaker 40. However, the invention is not restricted to these embodiments. In particular, the hearing aid device may also be a bone anchored hearing aid BAHA or a Cochlear implant. Furthermore, the hearing aid device may also be a neckloop and a telecoil receiver connected by hearing aid wireless technology. In the case of a neckloop, it is preferable to have a tactile notification in the neckloop in addition to or instead of an audio signal in the telecoil receiver.

Upon detecting an event, a transmitter or alerting sensor 12 to 17 transmits a wireless alerting signal to one or more of the notification and/or alerting receivers 20 to 23 via a radio connection 24, which may be a proprietary radio connection which may operate at a special frequency, for example 868.3 MHz, or any other suited radio connection. The receivers 20 to 23 are adapted to alert the user either by tactile (vibration), audio and/or visual alerting.

In addition to the alerting by the alerting receivers 20 to 23 of the wireless network 11, according to the invention the user is alerted by the hearing aid device 19 through the smart electronic device 18 acting as a gateway in the case of an alerting event detected by one of the alerting sensors 12-17. This will be explained in the following in more detail for different embodiments shown in FIGS. 1 to 4.

In the embodiment of FIG. 1, an alerting sensor 12-17, upon detecting an event, directly transmits a BLE alerting signal to the smart electronic device 18 via the Bluetooth Low Energy connection 36, which causes the smart electronic device 18 to send an alerting signal in the form of an audio stream to the hearing aid device 19 via the wireless radio connection 34. In this embodiment the transmitters 12-17 preferably comprise corresponding Bluetooth Low Energy senders 41-46.

Figure 2:
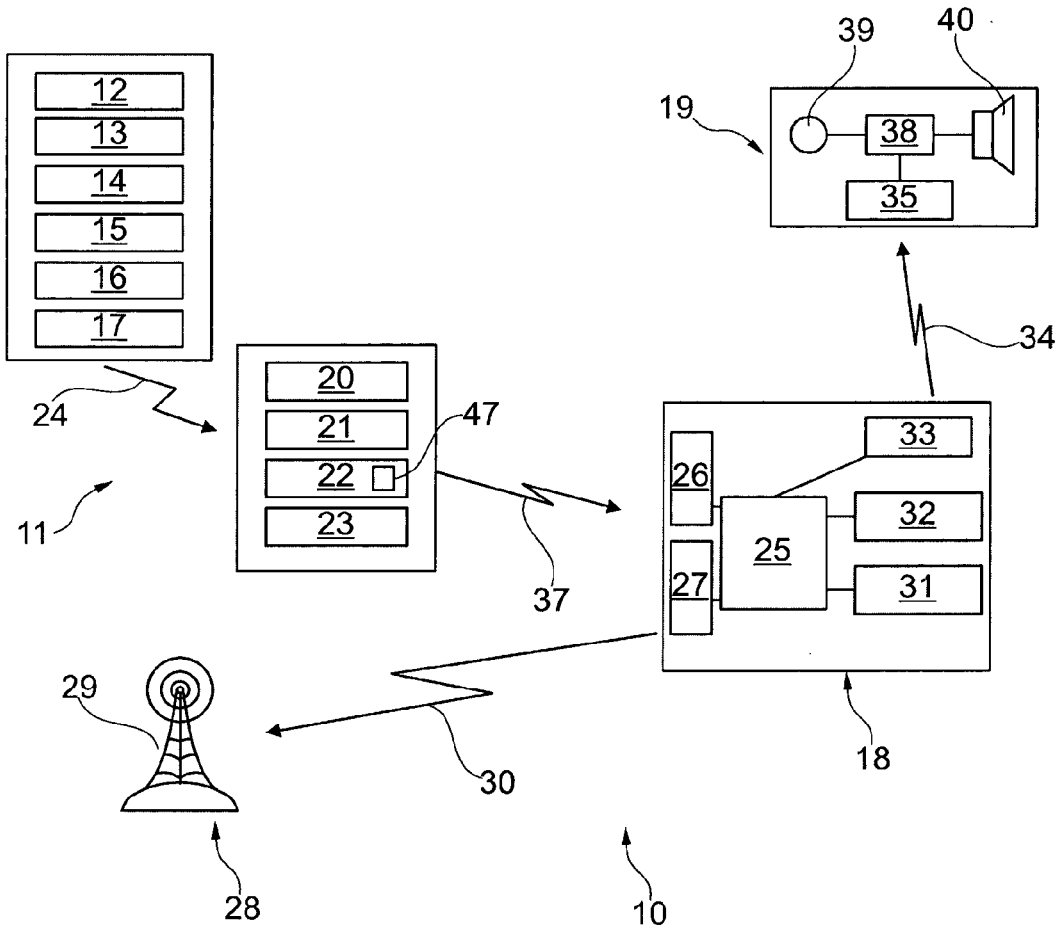
FIG. 2 shows an alerting system in a second embodiment of the invention.

In the embodiment of FIG. 2, an alerting receiver 20-23 of the wireless network 11, upon receiving a wireless alerting signal from one of the transmitters 12-17 via the radio connection 24, directly transmits a BLE alerting signal to the smart electronic device 18 via the Bluetooth Low Energy connection 37, which causes the smart electronic device 18 to send an alerting signal in the form of an audio stream to the hearing aid device 19 via the wireless radio connection 34. In this embodiment one of the receivers 20 to 23 preferably comprises a corresponding Bluetooth Low Energy sender 47. This embodiment may be preferably over the embodiment of FIG. 1 since in principle only one BLE sender 47 is required. The BLE sender 47 may also be a stand-alone device, for example an alarm clock or a medicine dispenser.

In the embodiments of FIGS. 1 and 2, an alerting signal received by the smart electronic device 18 via the BLE connection 36, 37 can additionally be forwarded to another device via the internet or another data connection, for example via the cellular mobile communication network 28. As an example, a bed shaker could be triggered using wire or a wireless connection, preferably BLE, by the electronic device 18.

Figure 3:
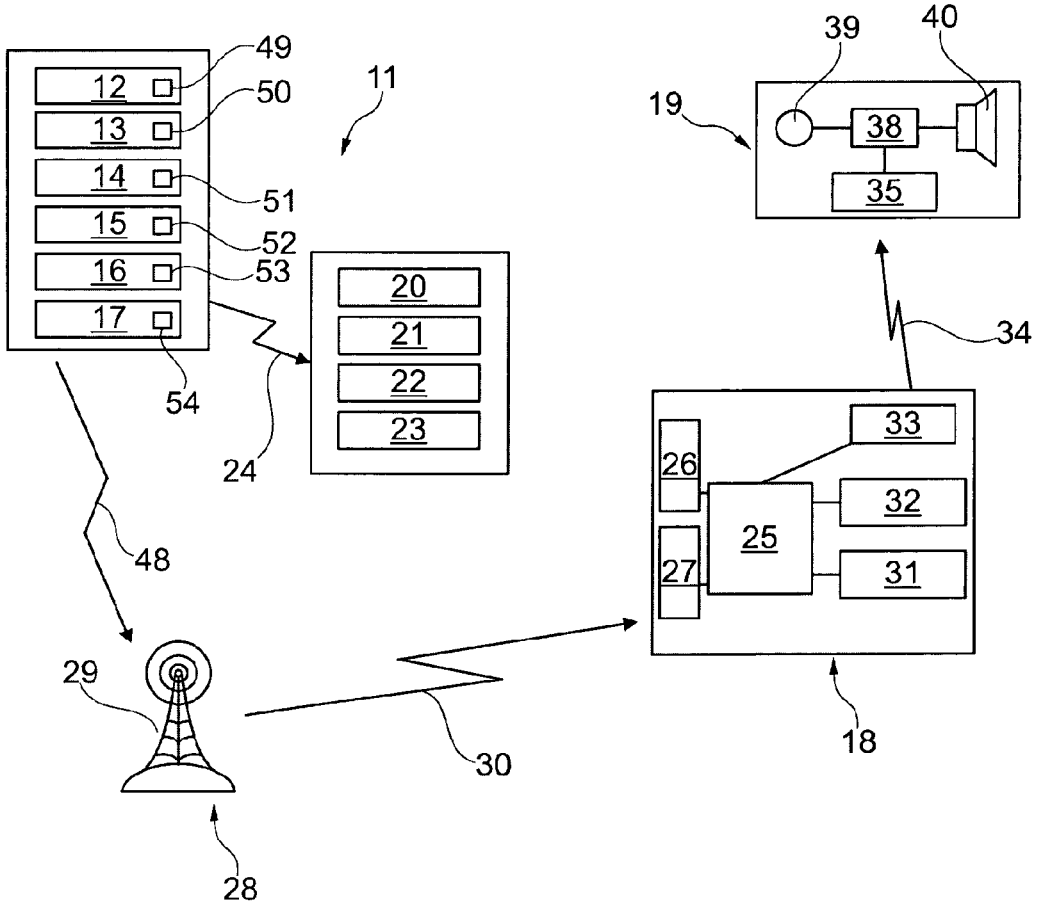
FIG. 3 shows an alerting system in a third embodiment of the invention.

In the embodiment of FIG. 3, an alerting sensor 12-17, upon detecting an event, transmits a wireless alerting signal to the smart electronic device 18 via a radio connection 48 and a cellular mobile communication network 28 comprising a plurality of base stations 29 using a digital communication standard like GSM, 3G, 4G, WiFi, an Internet connection or the like, which causes the smart electronic device 18 to send an alerts ing signal in the form of an audio stream to the hearing aid device 19 via the wireless radio connection 34. In this embodiment the transmitters 12-17 preferably comprise corresponding radio senders 49-54 adapted to communicate with the cellular mobile communication network 28.

Figure 4:
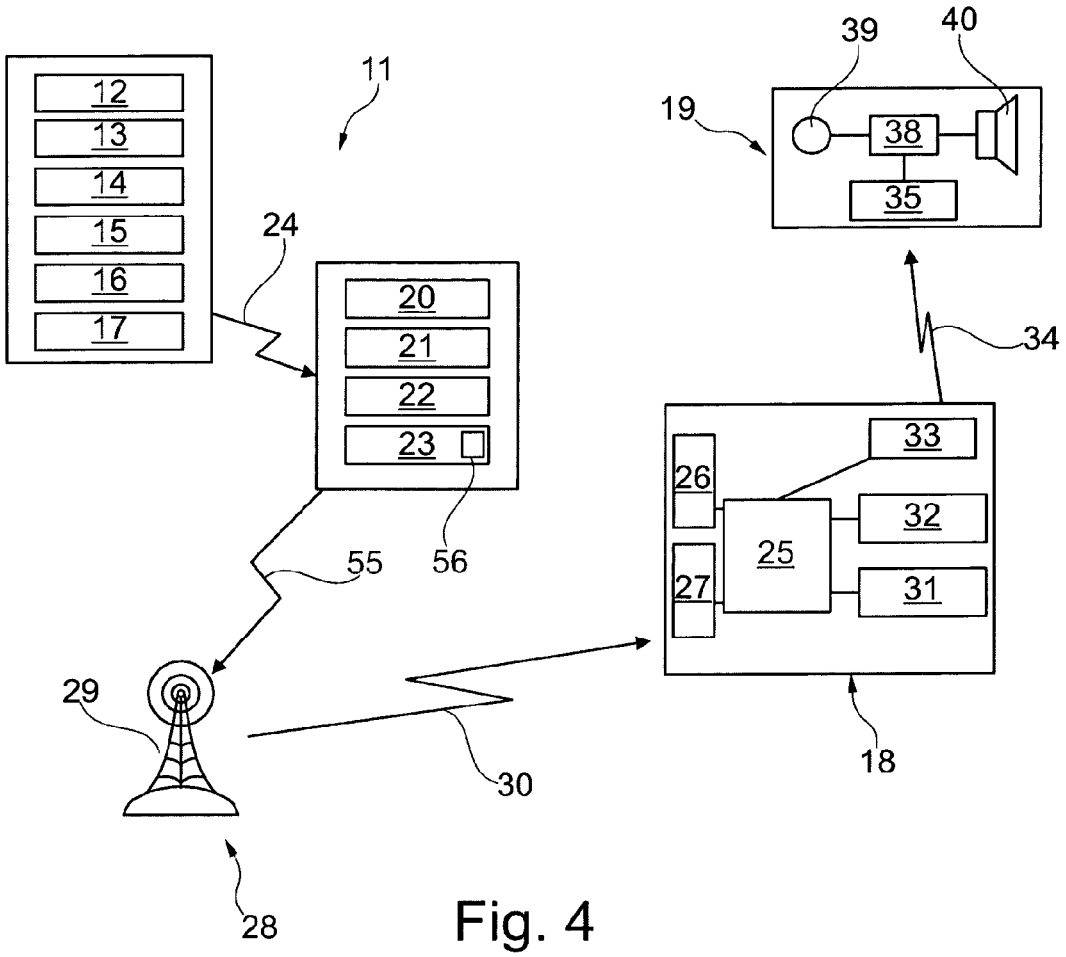
FIG. 4 shows an alerting system in a fourth embodiment of the invention.

In the embodiment of FIG. 4, an alerting receiver 20-23 of the wireless network 11, upon receiving a wireless alerting signal from one of the transmitters 12-17 via the radio connection 24, transmits a wireless alerting signal to the smart electronic device 18 via a radio connection 55 and a cellular mobile communication network 28 comprising a plurality of base stations 29 using a digital communication standard like GSM, 3G, 4G, WiFi, an Internet connection or the like, which causes the smart electronic device 18 to send an alerting signal in the form of an audio stream to the hearing aid device 19 via the wireless radio connection 34. In this embodiment one of the receivers 20 to 23 preferably comprises a corresponding radio sender 56 adapted to communicate with the cellular mobile communication network 28. This embodiment may be preferably over the embodiment of FIG. 3 since in principle only one radio sender 56 is required. The radio sender 56 may also be a stand-alone device.

The embodiments of FIGS. 1 to 4 can be combined, for example may one of the alerting receivers 20-23 comprise a BLE sender 47 and a radio sender 56.

In all embodiments, the smart electronic device 18 may be used as a remote control to change the settings, in particular controlling the characteristic and response of the hearing aid device 19, and for example to switch between different listening programs optimized for sound/noise environments such as "noisy background", "music" etc., tone control and so-called zoom control. The above described remote control function may be realized in the same application software as the gateway function of forwarding an alerting signal from the wireless network 11 to the hearing aid device 19. Alternatively, the remote control function may be realized in a separate remote control application software.

In addition to transmitting an alerting signal to the hearing aid device 19 via the radio connection 34, the smart electronic device 18, upon receiving an alerting signal from the wireless network 11 directly or indirectly through the cellular network 28, can provide a visual and/or tactile alerting signal to the user through the visual indicator 31 and/or the tactile actuator 32.

A pattern of an audio signal in the hearing aid device 19 and/or the visual and/or tactile signal in the smart electronic device 18 may be different depending on the type of event that has caused the alerting signal in the wireless network, enabling the user to identify the source of the alert and to react appropriately. This may be settable by the user using the application software of the electronic device 18.

EMBODIMENT 1

An alerting system (10) for deaf or hard of hearing people, said alerting system (10) comprising a wireless network (11) with one or more transmitters (12-17) adapted to detect events and, upon detecting an event, to transmit a wireless alerting signal to one or more receivers (20-23) adapted to alert a user, characterized in that the wireless network (11) is adapted to send an alerting signal to an electronic device (18) in order to allow the electronic device (18) to function as a gateway between said wireless network (11) and a hearing aid device (19).

EMBODIMENT 2

An alerting system according to embodiment 1, wherein said wireless network (11) comprises at least one sender (41-46;47) adapted to transmit an alerting signal directly to said electronic device.

EMBODIMENT 3

An alerting system according to embodiment 2, wherein said sender (41-46;47) is adapted to transmit the alerting signal from said wireless network (11) to said electronic device (18) using Bluetooth, in particular Bluetooth Low Energy.

EMBODIMENT 4

An alerting system according to any one of the preceding embodiments, wherein said wireless network (11) comprises at least one sender (49-54;56) adapted to transmit the alerting signal from said wireless network (11) to said electronic device (18) via a cellular network (28).

EMBODIMENT 5

An alerting system according to any one of the preceding embodiments, wherein said electronic device (18) is a smart electronic device, in particular a smart phone or a tablet computer.

EMBODIMENT 6

An alerting system according to any one of the preceding embodiments, wherein said one or more transmitters (12-17) is adapted to detect incoming calls on landline telephones, smoke alarm, door bell ringing, baby cry and/or alarm clock alarm.

EMBODIMENT 7

An application software to be implemented in an electronic device, wherein the application software controls said electronic device (18) to send a notification signal to a hearing aid device (19) upon receiving an alerting signal from a wireless network (11) for deaf and hard of hearing people.

EMBODIMENT 8

An application software according to embodiment 7, wherein the application software controls said electronic device (18) to transmit the notification signal to said hearing aid device (19) using Bluetooth, in particular Bluetooth Low Energy, or a proprietary radio transmission standard.

EMBODIMENT 9

An application software according to any one of the preceding embodiments 7 to 8, wherein the application software controls said electronic device (18) to transmit the notification signal to said hearing aid device (19) as an audio stream.

EMBODIMENT 10

An application software according to any one of the preceding embodiments 7 to 9, wherein said application software comprises a remote control function adapted to change settings of the hearing aid device (19).

EMBODIMENT 11

An application software according to any one of the preceding embodiments 7 to 10, wherein said application software comprises a function allowing to customize the alerting signal to be sent to the hearing aid device (19), in particular to set alerting sound characteristics.

EMBODIMENT 12

An application software according to embodiment 11, wherein said function comprises setting at least one alerting mode, wherein signals from per-defined transmitters of the wireless network only are transmitted to the hearing aid device depending on the set alerting mode.

EMBODIMENT 13

An application software according to any one of the preceding embodiments 7 to 12, wherein said application software is adapted to control said electronic device (18) to generate a visual and/or tactile signal to a user upon receiving an alerting signal from said wireless network (11).

EMBODIMENT 14

An application software according to any one of the preceding embodiments 7 to 13, wherein said application software is adapted to generate a pattern of an audio signal in the hearing aid device (19) and/or the visual and/or tactile signal in the electronic device (18) which is different depending on the type of event that has caused the alerting signal in the wireless network (11).

EMBODIMENT 15

An application software according to any one of the preceding embodiments 7 to 14, wherein said application software is adapted to forward an alerting signal received by the electronic device (18) from the wireless network (11) to another device via the internet or another data connection.

The invention claimed is:

1. An alerting system for a deaf or hard of hearing person, comprising:
- a wireless network;
- an electronic device; and
- a hearing aid device,
- wherein the wireless network comprises:
  - one or more alerting sensors; and
  - at least one alerting receiver,
  - wherein each alerting sensor of the one or more alerting sensors is configured to detect an event of a corresponding one or more events and, upon detecting the event of the one or more events, to transmit a wireless alerting signal to one or more alerting receivers of the at least one alerting receiver, and
  - wherein each alerting receiver of the at least one alerting receiver is configured such that upon receiving the wireless alerting signal, the alerting receiver of the at least one alerting receiver alerts a user,
- wherein the wireless network, upon the alerting sensor of the one or more alerting sensors detecting the event of the one or more events, sends an alerting signal to the electronic device,
- wherein the electronic device, upon receipt of the alerting signal from the wireless network, sends a radio signal to the hearing aid device such that the user wearing the hearing aid device is alerted,
- wherein at least one alerting sensor of the one or more alerting sensors is configured to detect the event of the one or more events selected from the group consisting of:
  - an incoming call on a landline telephone; a smoke alarm detector signaling; a door bell ringing; a baby crying; and an alarm clock signaling.

2. The alerting system according to claim 1,
- wherein the wireless network further comprises:
  - at least one sender,
  - wherein each sender of the at least one sender is configured to transmit the alerting signal directly to the electronic device.

3. The alerting system according to claim 2,
- wherein each sender of the at least one sender is configured to transmit the alerting signal directly to the electronic device using Bluetooth™.

4. The alerting system according to claim 2,
- wherein each sender of the at least one sender is configured to transmit the alerting signal directly to the electronic device using Bluetooth Low Energy™.

5. The alerting system according to claim 1,
- wherein the wireless network comprises:
  - at least one sender,
  - wherein each sender of the at least one sender is configured to transmit an alerting signal to the electronic device via a cellular network.

6. The alerting system according to claim 1,
- wherein the electronic device is a smart electronic device.

7. The alerting system according to claim 6,
- wherein the electronic device is a smart phone or a tablet computer.

8. The alerting system according to claim 1,
- wherein the first event of the one or more events is the incoming call on the landline telephone.

9. The alerting system according to claim 1,
- wherein the first event of the one or more events is the smoke alarm detector signaling.

10. The alerting system according to claim 1,
wherein the first event of the one or more events is the door bell ringing.

11. The alerting system according to claim 1,
wherein the first event of the one or more events is the baby crying.

12. The alerting system according to claim 1,
wherein the first event of the one or more events is the alarm clock signaling.

13. A non-transitory computer readable medium containing a set of instructions that when executed cause a processor to perform a method, wherein the method comprises:
providing an alerting system for a deaf or hard of hearing person,
wherein the alerting system for a deaf or hard of hearing person comprises:
a wireless network;
an electronic device; and
a hearing aid device,
wherein the wireless network comprises:
one or more alerting sensors; and
at least one alerting receiver,
wherein each alerting sensor of the one or more alerting sensors is configured to detect an event of a corresponding one or more events and, upon detecting the event of the one or more events, to transmit a wireless alerting signal to one or more alerting receivers of the at least one alerting receiver, and
wherein each alerting receiver of the at least one alerting receiver is configured such that upon receiving the wireless alerting signal, the alerting receiver of the at least one alerting receiver alerts a user,
wherein the wireless network, upon the alerting sensor of the one or more alerting sensors detecting the event of the one or more events, sends an alerting signal to the electronic device, and
wherein the electronic device, upon receipt of the alerting signal from the wireless network, sends a radio signal to the hearing aid device such that the user wearing the hearing aid device is alerted,
wherein at least one alerting sensor of the one or more alerting sensors is configured to detect the event of the one or more events selected from the group consisting of:
an incoming call on a landline telephone; a smoke alarm detector signaling; a door bell ringing; a baby crying; and an alarm clock signaling;
detecting the event of the one or more events,
wherein the event of the one or more events is selected from the group consisting of:
the incoming call on a landline telephone; the smoke alarm detector signaling; the door bell ringing; the baby crying; and the alarm clock signaling; and
controlling the electronic device such that the electronic device sends the radio signal to the hearing aid device upon receiving the alerting signal from the wireless network.

14. The computer readable medium according to claim 13,
wherein controlling the electronic device such that the electronic device transmits the radio signal to the hearing aid device comprises controlling the electronic device such that the electronic device transmits the radio signal to the hearing aid device using Bluetooth™.

15. The computer readable medium according to claim 13,
wherein controlling the electronic device such that the electronic device transmits the radio signal to the hearing aid device comprises controlling the electronic device such that the electronic device transmits the radio signal to the hearing aid device using Bluetooth Low Energy™.

16. The computer readable medium according to claim 13,
wherein controlling the electronic device such that the electronic device transmits the radio signal to the hearing aid device comprises controlling the electronic device such that the electronic device transmits the radio signal to the hearing aid device using a proprietary radio transmission standard.

17. The computer readable medium according to claim 13,
wherein controlling the electronic device such that the electronic device transmits the radio signal to the hearing aid device comprises controlling the electronic device such that the electronic device transmits the radio signal to the hearing aid device as an audio stream.

18. The computer readable medium according to claim 13,
wherein the method comprises allowing the electronic device to function as a remote control that allows the user to change settings of the hearing aid device.

19. The computer readable medium according to claim 13,
wherein the method comprises allowing the user to customize, via the electronic device, the radio signal to be sent to the hearing aid device.

20. The computer readable medium according to claim 19,
wherein the method comprises allowing the user to set, via the electronic device, alerting sound characteristics provided to the user by the hearing aid device.

21. The computer readable medium according to claim 19,
wherein allowing the user to customize the radio signal to be sent to the hearing aid device comprises allowing the user to set at least one alerting mode via the electronic device, and
wherein upon receipt of the alerting signal from the wireless network by the electronic device, the electronic device selectively transmits the radio signal to the hearing aid device depending on the at least one alerting mode.

22. The computer readable medium according to claim 13,
wherein the method further comprises controlling the electronic device to generate:
a visual signal to the user;
a tactile signal to the user; or
a visual signal and a tactile signal to the user,
upon receiving the alerting signal from the wireless network.

23. The computer readable medium according to claim 21,
wherein the method further comprises controlling the electronic device to:
send the radio signal to the hearing aid device such that the radio signal causes the hearing aid device to generate a pattern of an audio signal;
generate a visual signal to the user;

generate a tactile signal to the user; or generate a visual signal and a tactile signal to the user, which is different depending on a type of event of the event of the one or more events that has caused the wireless network to send the alerting signal to the electronic device.

24. The computer readable medium according to claim 13, wherein the method further comprises controlling the electronic device to forward the alerting signal received by the electronic device from the wireless network to another device via an internet or another data connection.

* * * * *